United States Patent [19]

Ball

[11] Patent Number: 4,751,884

[45] Date of Patent: Jun. 21, 1988

[54] HEIGHT ADJUSTABLE WORK TOP

[75] Inventor: Douglas C. Ball, Quebec, Canada

[73] Assignee: Hauserman, Inc., Cleveland, Ohio

[21] Appl. No.: 786,279

[22] Filed: Oct. 9, 1985

[51] Int. Cl.[4] ..... A47B 9/00; F16M 13/00

[52] U.S. Cl. ..... 108/144; 108/143; 248/420

[58] Field of Search ..... 108/144, 105, 106, 146, 108/147, 148, 138, 137, 102, 5, 108, 48, 143, 150, 136, 9; 248/420, 419; 74/103, 110

[56] References Cited

U.S. PATENT DOCUMENTS

| | | | |
|---|---|---|---|
| 1,006,834 | 10/1911 | Edwards | 108/144 X |
| 2,593,364 | 4/1952 | Thompson | 108/7 |
| 2,692,806 | 10/1954 | Grace | 108/143 |
| 2,694,612 | 11/1954 | Morrow | 108/144 X |
| 2,773,705 | 12/1956 | Hirak | 108/5 |
| 3,188,986 | 6/1965 | La Vigne | 108/144 |
| 3,370,556 | 2/1968 | Kooi | 108/146 |
| 3,853,297 | 12/1974 | Drolet | 108/144 X |
| 4,248,161 | 2/1981 | Adair et al. | 108/6 |
| 4,351,245 | 9/1982 | Laporte | 108/144 X |
| 4,440,096 | 4/1984 | Rice et al. | 108/147 X |
| 4,566,741 | 1/1986 | Eriksson et al. | 108/147 X |
| 4,568,071 | 2/1986 | Rice | 108/143 X |

FOREIGN PATENT DOCUMENTS

| | | | |
|---|---|---|---|
| 2757596 | 6/1979 | Fed. Rep. of Germany | 108/144 |
| 2099689 | 12/1982 | United Kingdom | 108/144 |
| 1087141 | 4/1982 | U.S.S.R. | 108/144 |

*Primary Examiner*—Kenneth J. Dorner
*Assistant Examiner*—José Chen
*Attorney, Agent, or Firm*—Renner, Otto, Boisselle & Sklar

[57] ABSTRACT

A work top is height adjustable and may tilt about a horizontal axis near the front edge. The work top may be mounted on an open office beam system or an office screen or partition in cantilever fashion or it may be a free standing unit. The work top is mounted for horizontal sliding movement and tilting on a horizontally extending undercarriage. The undercarriage includes an inclined strut journalled for sliding movement in a normally fixed inclined strut. A cable reeving system interconnects the work top and fixed inclined strut to maintain the work top in the same horizontal position regardless of its elevation. One or more tension springs, the tension of which may be adjusted, interconnect the under carriage and work top to counterbalance the weight of the work top and what may be positioned thereon such as a computer. A releasable latch locks the work top to the under carriage so that the work top may be locked in its height adjusted position. When the latch is released a light pull or push on the under carriage adjusts the work top to the desired height within its range of adjustment.

40 Claims, 4 Drawing Sheets

HEIGHT ADJUSTABLE WORK TOP

This invention relates to a low cost and simple height adjustable work top utilizing a low force horizontal spring compensated manual movement to obtain quickly and conveniently a work top height adjustment.

BACKGROUND OF THE INVENTION

Normally desks or work stations are not height adjustable. Desk chairs usually are, but this is not ergonomically effective since chairs are usually height adjusted properly to position the seated user from the floor.

Some work tops utilize jack screws, either manually or power driven. These systems normally work in a vertical direction and require substantial force to move the work top to its desired position, especially if the work top is supporting fairly heavy equipment such as computers. Such gear or screw systems are most commonly used in free standing tables and such systems must normally have a mechanical link between the two sides or legs since the lift must be equal on both sides. This further contributes to friction loss, cost and inefficiency within the system.

Another problem has to do with the weight of the top itself and what is supported thereon. As the weight or size becomes larger, the weight increases considerably and the mechanism developed for one size may work less well for a larger or heavier top. Also, if the system is designed for heavier loads, it is neither efficient nor cost effective for lighter loads.

Since even the smallest surface may have to lift the weight of a heavy computer, very high ratio gearing is normally employed. This creates another problem when a crank is used. It simply takes a lot of cranking. A motor, or motors, will do the job well enough, but lead to higher cost, possible noise and always the possibility of breakdown.

Another solution has been the use of hydraulic or gas cylinders. Once again the problem of a variety of weights of tops and loads makes selection of the components difficult. With a gas lift, while it lifts the surface with ease, the user must normally stand up and use his weight to force the top down. This is obviously easier for some people than for others. Moreover, gas cylinders are expensive and are prone to breakdown. Further, if more than one is used, it simply doubles the problems created by one.

In an open office beam system, such as manufactured by SunarHauserman of Cleveland, Ohio, under the trademark RACE, one or more work surfaces may be mounted on such beams to extend in cantilever fashion, and for longer or larger work surfaces they may additionally be supported on one or more outboard legs. Such beams are normally supported on legs at each end and may be height adjusted, again by manual jack screws. Also, the outboard legs of the longer or larger work tops may be height adjusted, usually by jack screws at their feet. Such height adjustment, at best, represents a compromise since the beam may support one or more additional work tops and such height adjust system is, needless to say, cumbersome. If a work top is attached to a panel or partition, it often requires two people with tools to change the work height. The result in such systems is that work surfaces tend to be set at a certain height and left there since a change in height would represent more effort than benefits gained.

It is therefore desirable to have a work top, either free standing, panel, partition, or beam mounted, which may quickly manually and conveniently be height adjusted by a simple spring compensated horizontal force at the work top height.

SUMMARY OF THE INVENTION

The present invention thus does provide a work top which may quickly and conveniently be height adjusted by hand with a simple spring compensated manual force at the work top height. The work top is not only height adjustable, but may tilt about a horizontal axis near the front edge. The unit may be free standing or more importantly, the work top may be mounted on an open office beam system, or an office screen or partition in cantilever fashion. The work top is mounted for horizontal sliding movement and tilting on a horizontally extending undercarriage which includes an inclined strut journalled for sliding movement in a fixed incline strut.

The telescoping inclined struts enable the work top to be moved vertically with less effort or force, and also load the system due to the weight of the top with a turning moment which extends downwardly at the upper end and upwardly at the lower end thus avoiding play or rattling. In a preferred embodiment, a cable reeving system interconnects the work top and the fixed inclined strut to maintain the work top in the same horizontal position regardless of its elevation. One or more tension springs, the tension of which may be adjusted, interconnect the undercarriage and work top to counterbalance the weight of the work top and what may be positioned thereon such as a computer. A releaseable latch locks the work top to the undercarriage so that the work top may be locked in its height adjusted position. When the latch is released a light pull or push on the carriage adjusts the work top to the desired height within its range of adjustment.

The present invention utilizes the principal of an inclined plane to move the work top vertically through the vertical component of such inclined movement. As indicated, the top may be spring loaded both to assist in such vertical movement and/or to maintain the top horizontally against a physical stop. In the latter case, a roller or rollers may be positioned at the rear edge of the top riding against a track or directly against the vertical surface of a beam, panel, or partition wall. In such situation the cable reeving system need not necessarily be employed.

The tension springs interconnecting the work top and the undercarriage on which the work top is horizontally slidably mounted may extend about pulleys both to increase the mechanical advantage of the spring but also to permit ready adjustment of the spring tension. Such pulleys may be mounted on a fore and aft adjustable plate so that the loading of such springs may readily be altered. An adjustment knob at the front edge of the work top readily permits the pulleys to be shifted with regard to the anchor points of the springs thus to control the tension of such springs. The work top may readily be tilted about a hinge interconnecting the undercarriage and the work top near the front edge of the work top by manually controlling a pair of interconnected jack screws at the rear of the work top, such jack screws extending through a barrel nut in a guide mounted at the rear of the undercarriage.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
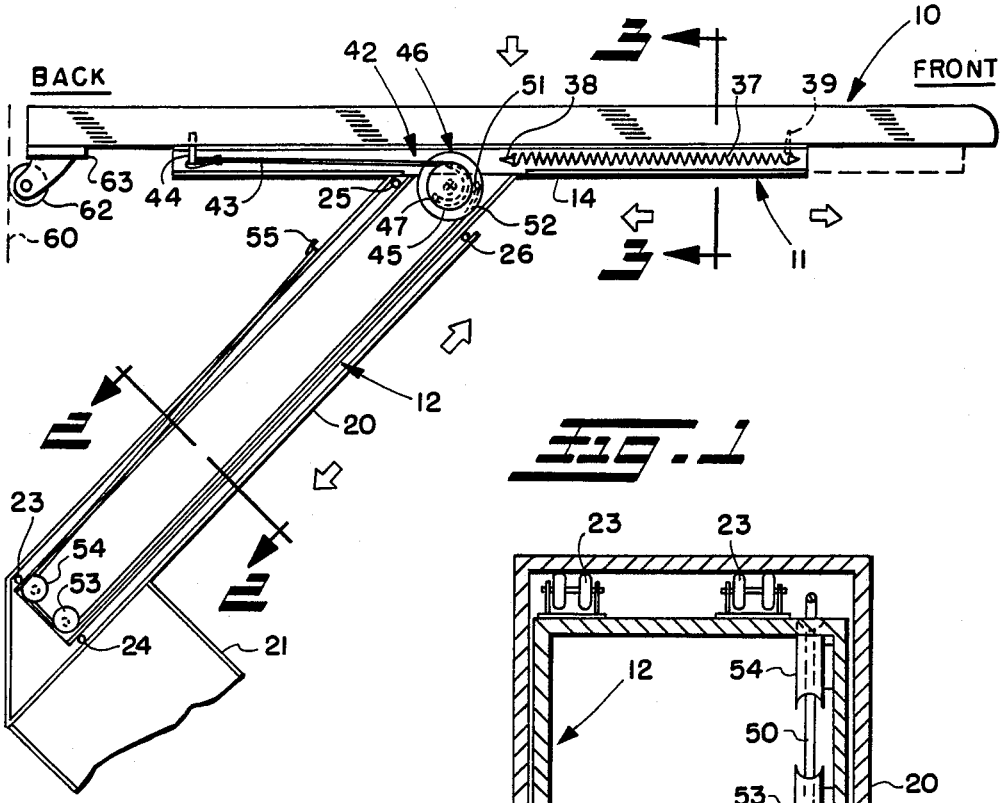
FIG. 1 is a schematic side elevation partially in section of a work station in accordance with the present invention in its lowermost position.

Referring first to FIGS. 1–4, there is illustrated a work station in accordance with the present invention which includes a work top 10 mounted on a rectangular frame undercarriage 11 from which extend inclined tubular struts 12. The tubular struts may be square or rectangular in sectional shape and extend downwardly from the approximate mid-point of the lateral frame members 13 and 14 of the undercarriage as seen perhaps more clearly in FIG. 9.

The laterally spaced tubular struts 12 telescope into fixed inclined struts 20 which may be mounted on pedestals 21 supporting the unit on the floor as a free standing unit as seen in the embodiment of FIGS. 1–4.

Figure 2:
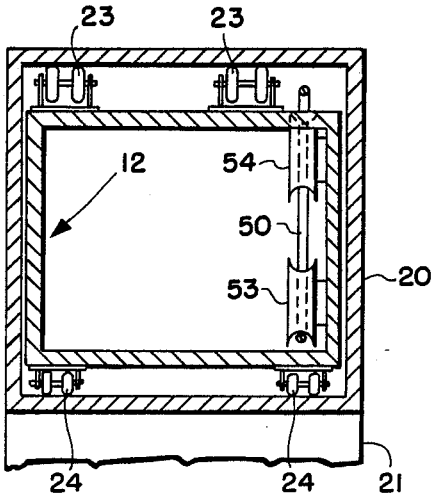
FIG. 2 is an enlarged transverse section through the inclined struts taken substantially on the line 2—2 of FIG. 1.
Figure 3:
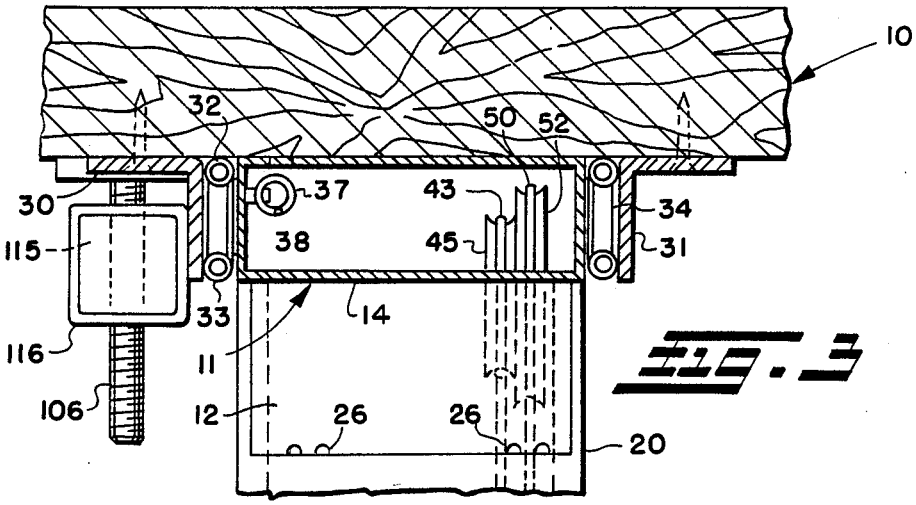
FIG. 3 is a vertical section through the work top as seen from the line 3—3 of FIG. 1.
Figure 4:
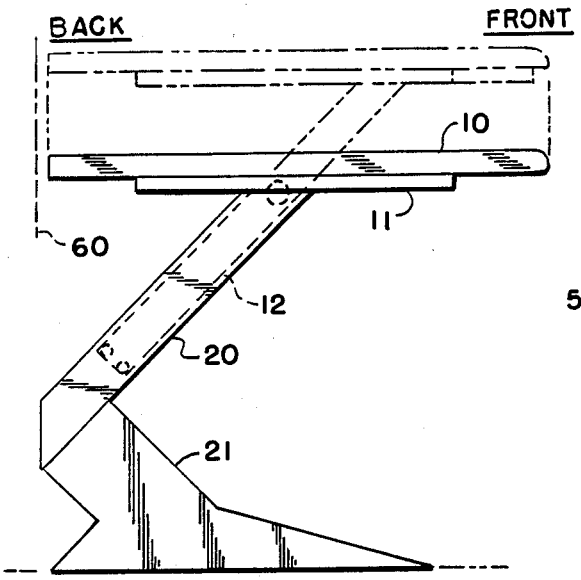
FIG. 4 is a side elevation of a free standing unit in accordance with the present invention with the work top shown in its lowermost position in full lines and its uppermost position in phantom lines.

As seen more clearly in FIGS. 1 and 2 the fixed and movable struts 20 and 12, respectively may be mounted for such telescoping movement by the use of paired rollers 23 and 24 mounted on the lower end of the movable strut, and similar rollers 25 and 26 mounted on the upper end of the fixed strut.

The work top 10 is mounted on the undercarriage 11 for horizontal sliding movement. As seen more clearly in FIG. 3 the underside of the top may be provided with angle struts 30 and 31 which include horizontally spaced tubular rails 32 and 33 between which ride grooved rollers mounted fore and aft on the lateral frames of the undercarriage 11. It will be appreciated that other sliding mountings may be utilized such as conventional drawer slides. In any event, the work top is mounted for limited horizontal sliding movement on the carriage 11. One or more tension springs interconnect the work top and the undercarriage as indicated at 37, such springs being anchored at 38 to the undercarriage and at 39 to the underside of the work top.

The work top and the fixed strut are tied together by cable reeving systems at each side of the work top shown generally at 42 so that as the undercarriage and inclined strut extending therefrom telescope upwardly with respect to the fixed strut, the work top moves rearwardly or to the left as seen in FIG. 1 to maintain the work top in the same horizontal position regardless of its elevation, and vice versa. Each cable reeving system comprises two cables, one shown at 43 and anchored at one end at 44 to the underside of the top. The opposite end of the cable 43 extends around the smaller sheave 45 of double pulley 46 and is anchored at 47. The other cable 50 is anchored at one end at 51 to the larger sheave 52 of such double pulley and extends interiorly of the movable inclined strut 12 to extend around pulleys 53 and 54 to be anchored at its opposite end at 55 to the fixed strut 20. The double pulley is of course journalled for rotation at the approximate intersection of the undercarriage and the movable inclined strut 12 which are integrally connected. The two sheaves of the double pulley have a ratio determined by the angle of the fixed and inclined struts with respect to horizontal which, in the illustrated embodiment is 45. It will be appreciated that other angles may be employed and that the ratios of the two sheaves of the double pulley would change accordingly.

It will also be appreciated that the two pulley system 53 and 54 at the lower end of the inclined movable strut 12 is the equivalent of one larger pulley, and that the spring system 37 acts to maintain the cables taut. In any event, the cable reeving system maintains the work top in the same horizontal position regardless of the elevation of the system and the lower the work top, the more tension on the spring system 37. It will, of course, be appreciated that the spring system may also extend between the fixed and inclined struts. In the absence of the pulley system which ties the work top to the proportional horizontal movement as the movable strut and carriage extends, a spring system may be used which simply forces the slidable work top back against the vertical track seen at 60 in FIG. 1 with one or more rollers 62 being mounted on the rear edge of the work top through suitable clevis brackets indicated at 63. In such case the rollers riding against such vertical tracks will maintain the top 10 in its proper horizontal position regardless of its elevation. Such rollers will normally be used with the mounting of a work top on a wall, panel or beam system as hereinafter described, and may be used with or without the cable reeving system.

Figure 5:
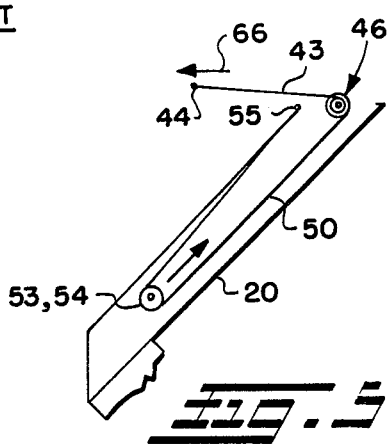
FIGS. 5–8 are schematic illustrations of the cable reeving system interconnecting the work top and the inclined fixed strut as the top moves from its lowermost to its uppermost position.
Figure 6:
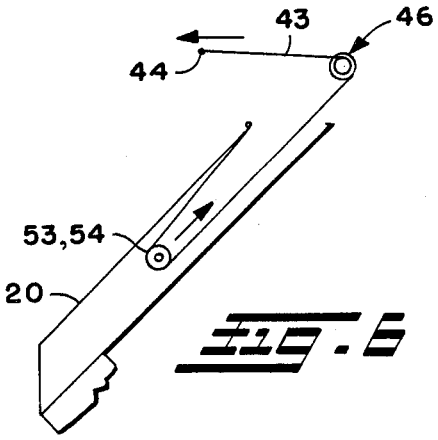
Figure 7:
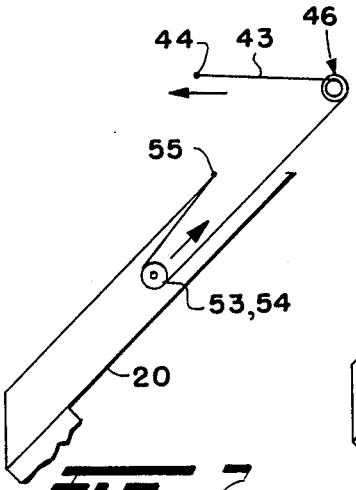
Figure 8:
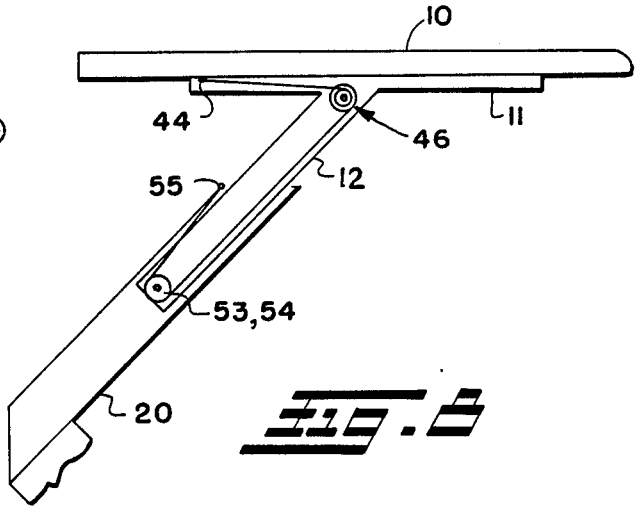

The operation of the cable reeving system is shown more clearly in FIGS. 5–8. Referring first to FIG. 5, as the work top 10 moves upwardly, the spring system 37 drives the work top rearwardly as indicated by the arrow 66 in FIG. 5 rotating the double pulley 46 in a counterclockwise direction as seen in FIG. 5 and maintaining the cables 43 taut. This also maintains the cables 50 taut as the movable inclined strut extends outwardly of the fixed strut 20 with the cable 50 wrapping around the larger diameter sheave of double pulley 46 as the pulley system 53, 54 moves upwardly. In the elevated position, the movable strut 12 has moved upwardly while the top 10 has moved rearwardly to maintain the latter in the same horizontal position as its height has been adjusted. Since the cable 50 is anchored at 55 to the fixed strut, reverse or downward motion of the the top maintains the cable system taut as the strut 12 moves downwardly and the top forwardly. The system is, of course, spring assisted to the up position, which is the rear position for the top.

Figure 9:
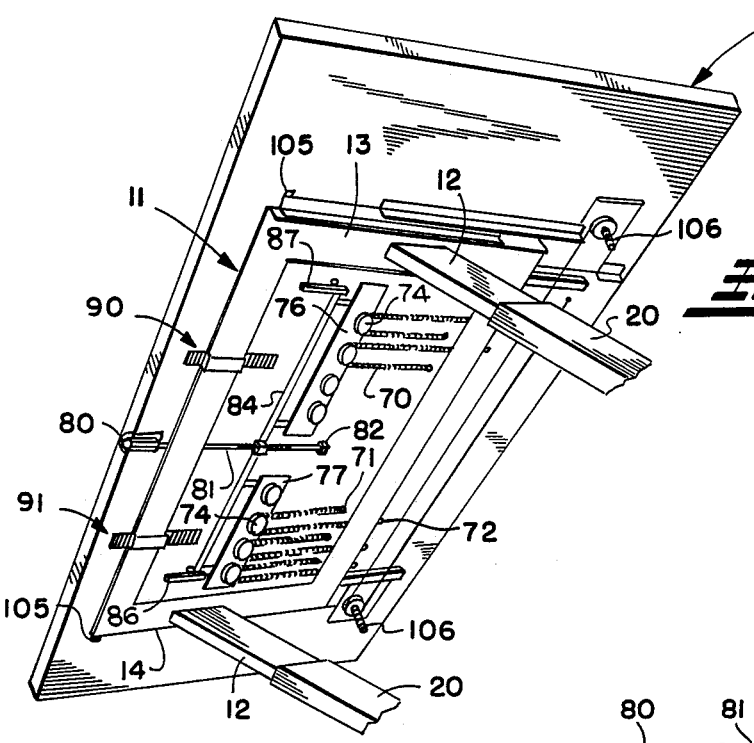
FIG. 9 is a perspective view of the underside of the work top illustrating the employement of a multiplicity of springs, the loading of which can be adjusted.
Figure 10:
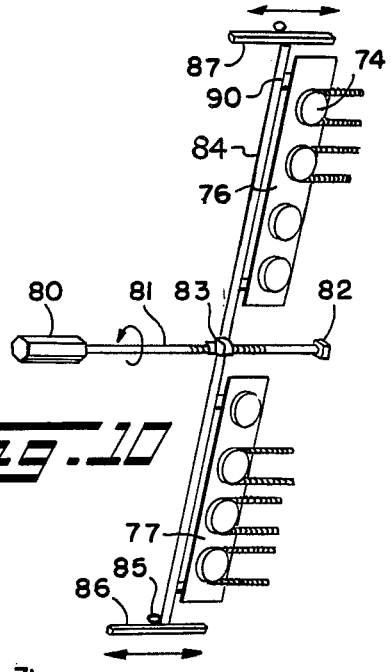
FIG. 10 is a partial perspective illustration of the adjustment mechanism for the pulleys around which the springs are trained.

Referring now to FIG. 9 there is illustrated a work top in accordance with the present invention which includes a plurality of springs 70, one end of which is anchored at 71 to the work top and at 72 to the undercarriage. The springs extend from such anchors about the pulleys 74 which are mounted on horizontal plates 76 and 77 extending transversely of the work top. The tension of such springs may be controlled by moving the plates 76 and 77 fore and aft of the spring anchors. To adjust the position of such pulleys and thus the tension of such springs, there is provided an adjustment knob 80 at the underside of the front edge of the work top which rotates screw 81 journalled and secured at its rear end at 82 to the underside of the top. Mounted on the screw 81 is a nut 83 secured to the center of a rod 84 which is provided at each end with journalled pinions 85 mounted on squaring racks 86 and 87 also secured to the underside of the top.

The plates 76 and 77 are mounted on such transverse rod for movement therewith by brackets seen at 90. Thus rotation of the knob 80 causes the plates 76 and 77 to be moved fore and aft the anchors of the springs trained about the pulleys mounted on such plates thus increasing or decreasing the load of the springs. The rack and pinion squaring mechanism moves each pulley uniformly despite the possibility of eccentric loading on each side of the single point adjustment. It will be appreciated that not every pulley may be provided with a spring, since such springs may be added or subtracted depending upon the load carried by the work top.

It should be appreciated that the spring-pulley system is primarily a convenience in view of readily available springs and space requirements. Obviously longer, tandem, double springs, or other types may be used which include pre-tensioning capabilities.

Figure 12:
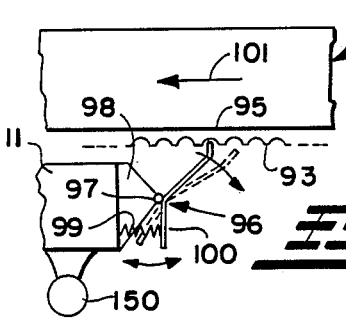
FIG. 12 is an enlarged vertical fragmentary section through one form of spring latch release for the work top.
Figure 11:
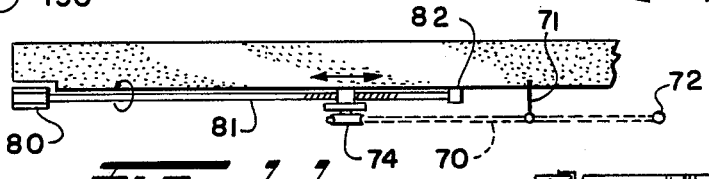
FIG. 11 is a fragmentary vertical section through the spring tension adjustment mechanism.

Once the work surface is adjusted to its proper height position, it may be locked into such position by the spring latch mechanisms indicated generally at 90 and 91 in FIG. 9. Such spring latch mechanisms are more clearly shown in FIG. 12 and comprises a rack 93 mounted on the underside of the top 10. The rack is adapted to engage with the end 95 of a spring loaded latching dog 96. The latching dog is pivoted at 97 to bracket 98 on the rear of the front transverse frame of the undercarriage 11 and a compression spring 99 bearing between such frame and arm 100 of the latching dog urges the latching dog in a counterclockwise direction as seen in FIG. 12. Finger pressure on the leg 100 of the latching dog will release it by moving it in a clockwise direction against the pressure of the spring 99 releasing the tip 95 from the rack 93, thus permitting horizontal movement of the top 10 with respect to the carriage 11. While two such latches are shown in FIG. 9, it will be appreciated that only one is required. When engaged the latching dog prevents the top from moving in the direction of the arrow 101 which is toward the front of the top thus preventing the top from moving downwardly.

Figure 13:
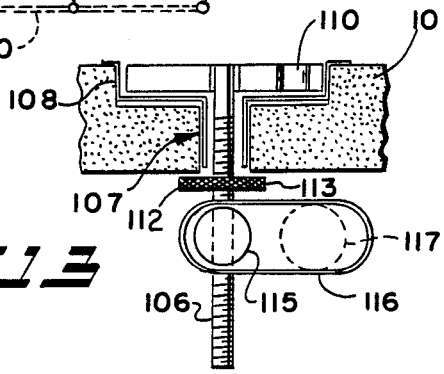
FIG. 13 is an enlarged vertical section through the tilt mechanism whereby the work top may be tilted about a hinge connection near the front edge of the undercarriage.

Referring now to FIG. 13, it is seen that the top 10 may be supported on undercarriage slides such as the angles 30 and 31 by a hinge connection 105 at the forward end (see FIG. 9) and by adjustable jack screws 106 at the rear end. The top may include inserts 107 through which the jack screws extend and are journalled and which include upper enlargements 108 housing recessed actuating knob or wheel 109. Such knob is secured to the top of the screw and is provided either with a finger hole 110 as illustrated, or it may be provided with a pop-up handle. The screw, immediately below the top, is provided with a sprocket 112 which may serve both as a thrust washer and also as a mounting for chain 113 which is trained about the sprocket on the opposite screw. In this manner the screws are cross connected for rotation in unison. The screw then extends through a barrel nut 115 in somewhat horizontally elongated guideway 116 which is slotted top and bottom. The guideway may be secured to and extend from the undercarriage slides such as angle 30 seen in FIG. 3. As the screws are actuated, the rear of the top will elevate and the barrel nut will move rearwardly in such slide as seen by the phantom line position 117 in FIG. 13. Without the tilt mechanism the top 10 may be supported or secured directly to such slides or angles as seen by the fasteners seen in FIG. 3.

Figure 14:
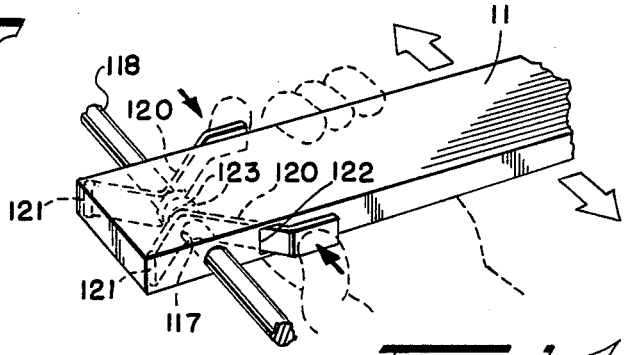
FIG. 14 is a schematic illustration of another form of spring latch release for the work top.

In FIG. 14 there is illustrated an alternative form of latch which may include rods 118 at each side of the work top which are secured to and move with the top and which extend through the front transverse frame of the undercarriage 11. The rods also extend through slightly oversize holes 119 in angled finger levers 120 which are pivoted in the corners of the undercarriage frame as indicated at 121. The distal or finger ends of the levers project through slots 122 in the fore and aft walls of the frame. The levers are separated by a compression spring 123 surrounding the rod. When thus separated the hole edges bind upon the rod and preclude rod (top)-frame (undercarriage) movement. The latch may be released by simply finger pressing the projecting ends toward each against the pressure of spring 123. A similar latch may be provided at the right hand side of the top.

Referring now to FIG. 14 it will be seen that the work top of the present invention may be mounted directly on a wall 124 with the inclined struts secured to vertical struts 125 which may be anchored directly to the wall surface by fasteners seen at 126. Rollers at the rear edge of the work top may ride against such vertical struts as previously indicated.

Figure 15:
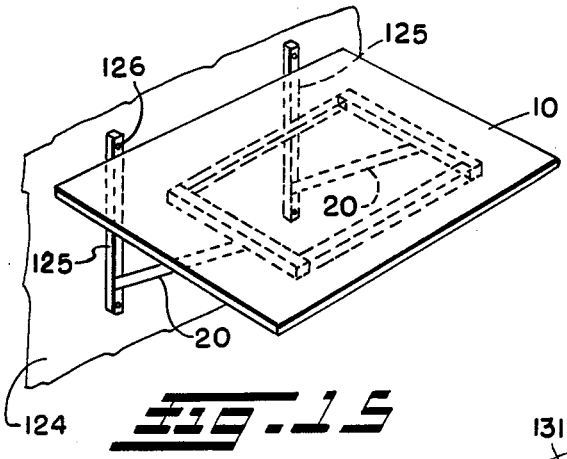
FIG. 15 is a fragmentary schematic illustration showing the work top of the present invention mounted on a wall.

In FIG. 15 there is illustrated a beam unit 127 such as used in the aforementioned RACE system and such beam units are mounted on legs 128 and 129 at each end. Wiring raceways extend along the tops of such beams at approximately work surface height as indicated at 130 and 131. The beam is constructed so that work surfaces, drawer units and the like may be mounted on the beam simply by hooking over the top of the outside panel. Work top 10 again includes the inclined struts 20 which are secured to the lower ends of vertical struts 132 and 133 which include hooks 134 and 135 at their tops, respectively. Pads or bumpers seen at 136 may be provided on the interior of such vertical struts to bear against the lower edge of the face of the beam holding the vertical struts in proper vertical relationship and also protecting the surface of the beam. In this manner, the work top 10 may be mounted anywhere along the face of the beam and quickly and conveniently be height adjusted independently of the height of the beam. Reference may be had to the copending application of Douglas C. Ball et al, Ser. No. 081,437, filed Oct. 3, 1979, for a more complete disclosure of such open office beam system.

Figure 16:
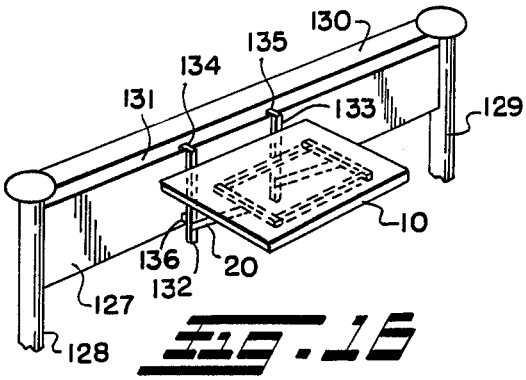
FIG. 16 is a similar schematic illustration illustrating a work top mounted on a beam in an open office system.
Figure 17:
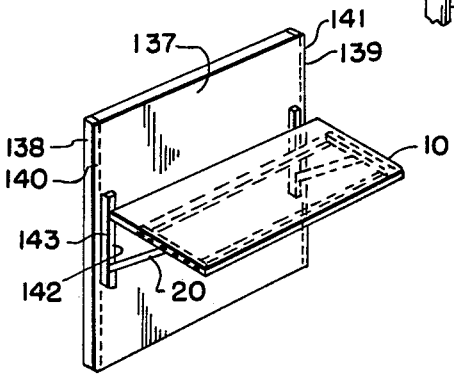
FIG. 17 is a schematic illustration of the work top mounted on a panel or partition system utilizing the slotted vertical at each end of the panel.

Referring now to FIG. 16, there is illustrated the work top of the present invention mounted a partition or panel 137 which includes verticals 138 and 139 which may each be provided with a vertically extending row of aligned short vertical slots seen at 140 and 141, respectively. In such embodiment, the inclined struts 20 are secured to vertical struts 142 which are provided with bracket plates 143 which include projecting hooks which enable the vertical struts to be mounted directly on the panel face by engaging the hooks in the selected slots. In this manner, the work top may be mounted at a selected height position directly on the face of the panel and then height adjusted within its own range. It will be appreciated that the work top may be mounted directly in the slots as illustrated or on an intermediate load bar, all as shown, for example, in the manner seen in prior U.S. Pat. No. 4,018,019 to Raith et. al., issued Apr. 19, 1977.

With the present invention, the front underside of the carriage acts as a pull bar or handle and releasing the latch and pulling the front section of the undercarriage with a fairly light force causes the work top to elevate through its range which may, for example, be from about the height of from approximately 24 inches to 29 inches above the floor. The reeving or spooling mechanism seen in FIGS. 5–8 ensures that the top always rises in a vertical plane. Also, having the springs run over a pulley and back to the undercarriage ensures minimal change between the force extended and the force at rest and with the adjustment noted one is able to adjust and preload the system as desired. Greater increments of loading may, of course, be obtained by adding or removing springs. Since each plate 76 or 77 includes four spring pulleys, the addition or removal of springs is readily accomplished. In addition, it will be noted that the front transverse frame of the undercarriage may be provided with a handle seen at 150 in FIG. 12 to facilitate the horizontal movement of the undercarriage in turn to adjust in height the work top.

What is claimed is:

1. An adjustable height work station comprising a work top, a fixed support extending at an angle inclined to horizontal, a movable strut mounted for movement along the fixed support, a horizontal member mounted on said movable strut, wherein said work top is mounted for sliding movement on said horizontal member, and cable means interconnecting said work top and said fixed support operative to maintain said work top against horizontal movement as said movable strut moves along the fixed support.

2. A work station as set forth in claim 1 including spring means operative to urge said work top upwardly.

3. A work station as set forth in claim 2 wherein said spring means is also operative to urge said work top horizontally with respect to said horizontal member.

4. A work station as set forth in claim 3 wherein said spring means comprises a tension spring extending between said work top and horizontal member.

5. A work station as set forth in claim 4 including a plurality of tension springs extending between said work top and horizontal member, each trained about a pulley.

6. A work station as set forth in claim 5 including means to adjust the position of the pulley to alter the loading of such tension springs.

7. A work station as set forth in claim 6 wherein said tension springs have ends and said pulleys are mounted on plates which may be moved toward and away from the ends of said tension springs.

8. A work station as set forth in claim 7 including an adjustment means for moving said plates.

9. A work station as set forth in claim 8 wherein said adjustment means comprises a single point adjustment, and squaring means to move said plates uniformly toward and away from the ends of said tension springs.

10. A work station as set forth in claim 1 wherein said work top includes a front and rear, and said work station further includes an interior partition or room divider, and means mounting said fixed support to such partition or room divider extending toward the front of the work top so that the work top is supported in cantilever fashion from the partition or room divider, with the rear of the work top remaining uniformly spaced from the partition or room divider regardless of the position of the movable strut relative to the fixed support.

11. A work station as set forth in claim 10 including a roller at the rear of said work top which rides against such partition or room divider.

12. A work station as set forth in claim 1 including a floor mounted pedestal with said fixed support mounted thereon so that the work station is a free standing unit.

13. A work station as set forth in claim 1 wherein said cable means includes a pulley at the intersection of the movable strut and horizontal member with said cable means attached thereto.

14. A work station as set forth in claim 13 wherein said pulley is a double pulley with two pulley sheaves of different diameter.

15. A work station as set forth in claim 14 including two cables attached to said double pulley, one cable connected to said work top and the other cable connected to said fixed support.

16. A work station as set forth in claim 15 wherein the cable connected to said fixed support extends about a further pulley at the lower end of said movable strut.

17. A work station as set forth in claim 1 including lock means operative to lock said work top in height adjusted position.

18. A work station as set forth in claim 17 wherein said lock means comprises a releaseable lock between said top and horizontal member.

19. A work station as set forth in claim 18 wherein said last mentioned means comprises a rack on the underside of said work top, and a spring loaded dog operative to engage and release said rack.

20. A height adjustable work station comprising a work top, a frame supporting said work top, said frame including an angularly inclined downwardly extending slide strut, a fixed frame including an upwardly inclined support strut supporting said slide strut for inclined movement therealong, and automatic means operative automatically and simultaneously to maintain said work top against horizontal movement as said slide strut moves with respect to said support strut.

21. A work station as set forth in claim 20 including spring means operative to urge said work top upwardly.

22. A work station as set forth in claim 20 wherein said work top includes a front and rear, and said work station further includes an interior partition or room divider, and means mounting said fixed support to such partition or room divider extending toward the front of the work top so that the work top is supported in cantilever fashion from the partition or room divider, with the rear of the work top remaining uniformly spaced from the partition or room divider regardless of the position of the slide strut relative to the support strut.

23. A work station as set forth in claim 22 including a roller at the rear of said work top which rides against such partition or room divider.

24. A work station as set forth in claim 20 including a floor mounted pedestal with said fixed support being mounted thereon so that the work station is a free standing unit.

25. A work station as set forth in claim 20 including lock means operative to lock said work top in height adjusted position.

26. A work station as set forth in claim 25 wherein said lock means comprises a releaseable lock between said work top and frame.

27. A work station as set forth in claim 25 wherein said lock means comprises a rack on the underside of said work top, and a spring loaded dog on said frame operative to engage and release said rack.

28. A work station as set forth in claim 25 wherein said lock means comprises a rod, and a spring loaded lever binding on said rod in one position and releasing said rod in another.

29. A height adjustable work station comprising a work top, a frame supporting said work top, said frame including an angularly inclined downwardly extending slide strut, a fixed frame including an upwardly inclined support strut for inclined movement therealong, and spring means operative to urge said work top upwardly and urge said work top horizontally with respect to said frame, said spring means including automatic means operative simultaneously to maintain said work top against horizontal movement as said slide strut moves with respect to said support strut.

30. A work station as set forth in claim 29 wherein said spring means comprises a tension spring extending between said work top and frame.

31. A work station as set forth in claim 30 including a plurality of tension springs extending between said work top and frame, each trained about a pulley.

32. A work station as set forth in claim 31 including means to adjust the position of the pulley to alter the loading of such springs.

33. A work station as set forth in claim 32 wherein said tension springs have ends and said pulleys are mounted on plates which may be moved toward and away from the ends of said tension springs.

34. A work station as set forth in claim 33 including an adjustment means for moving said plates.

35. A work station as set forth in claim 34 wherein said adjustment means comprises a single point adjustment, and squaring means to move said plates uniformly toward and away from the ends of said tension springs.

36. A height adjustable work station comprising a work top, a frame supporting said work top, said frame including an angularly inclined downwardly extending slide strut, a fixed frame including an upwardly inclined support strut supporting said slide strut for inclined movement therealong, and automatic means operative simultaneously to maintain said work top against horizontal movement as said slide strut moves with respect to said support strut, said automatic means comprising cable means interconnecting said work top and said support strut to maintain said work top against horizontal movement as said slide strut moves.

37. A work station as set forth in claim 36 wherein said cable means includes a pulley at the intersection of the slide strut and frame with said cable means attached thereto.

38. A work station as set forth in claim 37 wherein said pulley is a double pulley with two pulley sheaves of different diameter.

39. A work station as set forth in claim 38 including two cables attached to said double pulley, one cable connected to said work top and the other cable connected to said support strut.

40. A work station as set forth in claim 39 wherein the cable connected to said support strut extends about a further pulley at the lower end of said slide strut.

* * * * *